US009368920B2

(12) United States Patent
Lukas

(10) Patent No.: US 9,368,920 B2
(45) Date of Patent: Jun. 14, 2016

(54) PLUG-CABLE UNIT FOR A REMOVABLE CODING PLUG, CODING PLUG AND METHOD FOR CONFIGURING A FUNCTIONAL UNIT WITH A CODING PLUG

(75) Inventor: Stefan Lukas, St. Peter (AT)

(73) Assignee: Logicdata Electronic & Software Entwicklunga GmbH, Deutschlandsberg (AT)

( * ) Notice: Subject to any disclaimer, the term of this patent is extended or adjusted under 35 U.S.C. 154(b) by 1086 days.

(21) Appl. No.: 13/498,535

(22) PCT Filed: Sep. 27, 2010

(86) PCT No.: PCT/EP2010/064274

§ 371 (c)(1),
(2), (4) Date: Jun. 8, 2012

(87) PCT Pub. No.: WO2011/036295

PCT Pub. Date: Mar. 31, 2011

(65) Prior Publication Data

US 2012/0244743 A1 Sep. 27, 2012

(30) Foreign Application Priority Data

Sep. 28, 2009 (DE) ..... 10 2009 043 257

(51) Int. Cl.
*H01R 11/00* (2006.01)
*H01R 13/66* (2006.01)

(52) U.S. Cl.
CPC ..... *H01R 13/665* (2013.01); *Y10T 29/49169* (2015.01)

(58) Field of Classification Search
CPC ..... H01R 13/665; H01R 13/6675; H01R 13/7039; H01R 29/00; Y10T 29/49169; A47C 20/41; A47C 31/008; A47C 1/0242; A47B 9/00; A61G 7/018
USPC ..... 307/149
See application file for complete search history.

(56) References Cited

U.S. PATENT DOCUMENTS

| | | | | | |
|---|---|---|---|---|---|
| 5,660,567 | A * | 8/1997 | Nierlich | A61B 5/14551 | 439/620.21 |
| 5,692,917 | A * | 12/1997 | Rieb | H01R 3/6397 | 340/543 |
| 6,079,065 | A * | 6/2000 | Luff | A47C 20/041 | 5/613 |
| 6,126,610 | A * | 10/2000 | Rich | A61M 16/0051 | 128/204.23 |
| 7,129,716 | B2 * | 10/2006 | Schroeder | H01R 13/665 | 324/691 |
| 2009/0012634 | A1 * | 1/2009 | Koch | A47C 20/041 | 700/90 |

FOREIGN PATENT DOCUMENTS

| | | | | |
|---|---|---|---|---|
| AT | EP 1646139 A2 * | 4/2006 | | B25H 1/14 |
| DE | 37 26 262 A1 | 2/1989 | | |

(Continued)

*Primary Examiner* — Jared Fureman
*Assistant Examiner* — Michael Warmflash
(74) *Attorney, Agent, or Firm* — Slater Matsil, LLP

(57) ABSTRACT

In one embodiment, a plug-cable unit includes a plug connector which is equipped to receive a coding plug. A cable is used for connecting to a functional unit to be controlled, in particular of an electromechanically adjustable piece of furniture. A plug module is used for connecting to a control device of the piece of furniture. In one embodiment, a coding plug includes at least two ports for connecting to related contacts of a plug connector of a plug-cable unit, and at least one electronic component having at least one parameter of a functional unit.

17 Claims, 4 Drawing Sheets

(56) References Cited

FOREIGN PATENT DOCUMENTS

| | | | |
|---|---|---|---|
| DE | 198 51 473 | A1 | 5/2000 |
| DE | 202 19 875 | U1 | 4/2004 |
| DE | 298 25 050 | U1 | 8/2004 |
| DE | 10 2006 010 640 | A1 | 9/2007 |
| EP | 0 304 574 | B1 | 9/1992 |
| EP | 1 646 139 | A2 | 4/2006 |
| JP | 08-321360 | A | 12/1996 |
| WO | WO 2005/009797 | A1 | 2/2005 |

* cited by examiner

PLUG-CABLE UNIT FOR A REMOVABLE CODING PLUG, CODING PLUG AND METHOD FOR CONFIGURING A FUNCTIONAL UNIT WITH A CODING PLUG

This patent application is a national phase filing under section 371 of PCT/EP2010/064274, filed Sep. 27, 2010, which claims the priority of German patent application 10 2009 043 257.4, filed Sep. 28, 2009, each of which is incorporated herein by reference in its entirety.

TECHNICAL FIELD

The invention relates to a plug-cable unit, a coding plug, a setting device, in particular, for an electromechanically adjustable piece of furniture and to a method for configuring a functional unit, in particular, of the piece of furniture.

BACKGROUND

In the field of electromechanically adjustable pieces of furniture such as chairs, beds or tables, various drive mechanisms for setting the position of a functional portion of the piece of furniture are employed. A functional portion of a piece of furniture is an individually controllable portion of the piece of furniture, being coupled to an adjoining portion via a joint or transmission, for instance. In order to move the functional portion electromechanically, a functional unit is provided which comprises at least one motor and an actuator.

In order to configure the functional unit by a related control in accordance with the type of the functional unit, for instance of the motor, an identification or detection of the functional unit is required. From European Patent document EP 1646139 A2, it is known to install an additional electrical resistor, which allows the respective functional unit to be identified by the control, in a cable connecting the functional unit to the control device. Having identified the type of the functional unit, the functional unit is configured and triggered depending on its type.

Installing the resistor in the cable, however, results in a separate cable that has to be prepared for each type of the functional unit, causing higher costs, e.g., in stock-keeping. Further, higher efforts are required in order to avoid the various cables being mixed up during assembly.

SUMMARY OF THE INVENTION

In one aspect the configuration of a functional unit of an electromechanically adjustable piece of furniture is simplified and made less expensive.

In one embodiment, a plug-cable unit comprises a plug connector, a cable and a plug module. The plug connector is arranged for receiving a coding plug. The cable is designed for connecting to a functional unit to be controlled, in particular of an electromechanically adjustable piece of furniture. The plug module is arranged for connecting to a control device of the piece of furniture. In this arrangement, the plug connector has an electrically conductive connection to the plug module and the plug module has an electrically conductive connection to the cable.

The plug-cable unit connects the functional unit to the control device. A coding plug associated to the functional unit is plugged into the plug connector. The plug module transfers information of the coding plug to the control device. Via the plug-cable unit, the control device configures and controls the functional unit depending on the transferred information.

Due to the fact that a coding plug associated with the respective functional unit of the piece of furniture can be plugged into the plug-cable unit and hence a corresponding configuration of the functional unit can be carried out, use of the same cable is made possible. Advantageously, it is possible to insert the coding plug only after assembly of the plug-cable unit.

The functional unit comprises at least one motor and an actuator coupled thereto, performing an adjustment process on the piece of furniture or on a functional portion of the piece of furniture by means of an interaction dictated by the control device. The height of a table is adapted, for instance. In another example, the functional unit adjusts the inclination of a backrest of a chair, for example.

The plug module comprises electrical contacts realized as pins or openings. The contacts are designed for transferring signals. The housing is made from an insulating material in an injection-molding technique, for instance. It serves for sheathing the plug-cable unit and ensures its strength and shielding.

In a further development, the plug connector comprises at least two contacts which are designed for transferring at least one parameter of the functional unit to be controlled.

The at least one parameter comprises information allowing the parameter to be associated to the functional unit. The at least one parameter is characteristic for the functional unit. It allows the control device to identify the respective functional unit and to adapt the triggering scheme of the functional unit to its type.

The plug connector is realized so as to have at least two poles. The contacts are also referred to as pins. Advantageously, the functional unit is configured by means of the at least one parameter. In doing so, the parameter is characteristic for the motor and/or the actuator used in the functional unit, for example.

In a further embodiment, the plug module, the plug connector and the cable are arranged mechanically connected to each other in a housing of the plug-cable unit.

The mechanical connection between the cable and the housing relates to the end part of the cable.

In a further development, the plug module and the cable are arranged mechanically connected to each other in the housing of the plug-cable unit. The plug connector is mounted in a receptacle outside the housing on the cable.

The separate receptacle for the plug connector is installed at any place of the cable.

In one embodiment, a coding plug comprises at least two ports for connecting to related contacts of a plug connector of a plug-cable unit, and at least one electronic component. The electronic component comprises at least one parameter of a functional unit to be controlled, in particular, of an electromechanically adjustable piece of furniture. The at least two ports are each mechanically and electrically connected to the at least one electronic component and are arranged in a housing of the coding plug.

The at least one parameter comprised by the electronic component is supplied to the plug connector of the plug-cable unit via the at least two ports of the coding plug. The ports of the coding plug are realized as pins or sockets so as to be complementary to the contacts of the plug connector of the plug-cable unit.

The at least one parameter advantageously allows a configuration of the functional unit to be controlled without exchanging the cable of the plug-cable unit.

In a further embodiment, the electronic component comprises a passive component.

The passive component is realized as a resistor or a capacitance, for instance. The value of the resistor or capacitance constitutes the at least one parameter.

In a further development, the electronic component comprises a digital memory chip.

The digital memory chip is programmed, for instance, so that it holds operational data of the functional unit such as stroke, speed, height, inclination in relation to the impulse. In an advantageous implementation, the digital memory chip comprises all operational data of the functional unit which are required by the control device, whereby a completely autonomous configuration of the control device is achieved.

In a further embodiment, the coding plug comprises a visual identification which is attached to its housing and designed so as to be suitable to the at least one parameter.

Thus, the visual identification allows a simple allocation between the coding plug and the functional unit, i.e., to the type of the motor or actuator.

In one embodiment, a setting device, in particular, for an electromechanically adjustable piece of furniture, comprises a plug-cable unit, a coding plug, a control device of the piece of furniture as well as a functional unit, to be controlled, of the piece of furniture. The functional unit to be controlled is connected to the control device via the plug-cable unit. At least one parameter of the functional unit to be controlled comprised by the electronic component of the coding plug is supplied to the control device via the plug-cable unit.

On the basis of the parameter, the control device identifies the type of the functional unit, retrieves the operational data matching thereto and configures the functional unit according to its type.

Each type of functional unit has a coding plug comprising at least one corresponding parameter associated to it. Thus, the control device is advantageously able to configure the functional unit according to its type without exchanging the cable.

In a further development, the functional unit to be controlled comprises a motor connected to the cable of the plug-cable unit, and an actuator driven by the motor. The actuator is arranged for adjusting the functional unit to be controlled.

Through the interaction of motor and actuator, the functional unit is adjusted and thus the position of the piece of furniture connected to it or of the functional portion of the piece of furniture, for instance, is adapted.

In a further development, the control device, for controlling the functional unit as a function of the at least one parameter, comprises an evaluation unit connected to the plug module of the plug-cable unit, and a memory device connected thereto and designed for holding the at least one parameter.

The evaluation unit reads out the at least one parameter via the plug module, stores this parameter in the attached memory device, associates the parameter to the corresponding type of the functional unit and retrieves, e.g., the operational data associated to this parameter from the memory device. The subsequent process of triggering the functional unit is carried out on the basis of these operational data.

In one embodiment, a method of configuring a functional unit, in particular, of an electromechanically adjustable piece of furniture, comprises the following steps:

plugging a coding plug into a plug-cable unit, connecting a functional unit of the piece of furniture to a control device of the piece of furniture via the plug-cable unit, reading out at least one parameter, comprised by the coding plug, of the functional unit of the piece of furniture, and adjusting the control device of the piece of furniture for controlling the functional unit as a function of the parameter.

During production of the functional unit, the coding plug matching with the respective functional unit is inserted in the plug-cable unit. To give an example, a coding plug associated to the type of the motor used in the functional unit is inserted. During assembly of the piece of furniture, the control device is connected to the functional unit. The control device identifies the functional unit and retrieves a related set of configuration data from the memory device. The set of configuration data provides for an optimal operation of the functional unit.

Advantageously, the method allows, due to the functional unit being identified by the control device, to use the same control device even if different types of functional units are employed. This simplifies the stock-keeping of the control devices. Advantageously, the method further facilitates the configuration of the functional unit with the aid of the coding plug without any cable exchange so that the same cable may be used even for different types of functional units.

BRIEF DESCRIPTION OF THE DRAWINGS

The invention will be explained in more detail below on the basis of the figures. All components with equal function or effect are provided with the same reference symbols. Insofar as components are identical in their function in the individual figures, their description will not be repeated in each of the figures. In the drawings.

Figure 1:
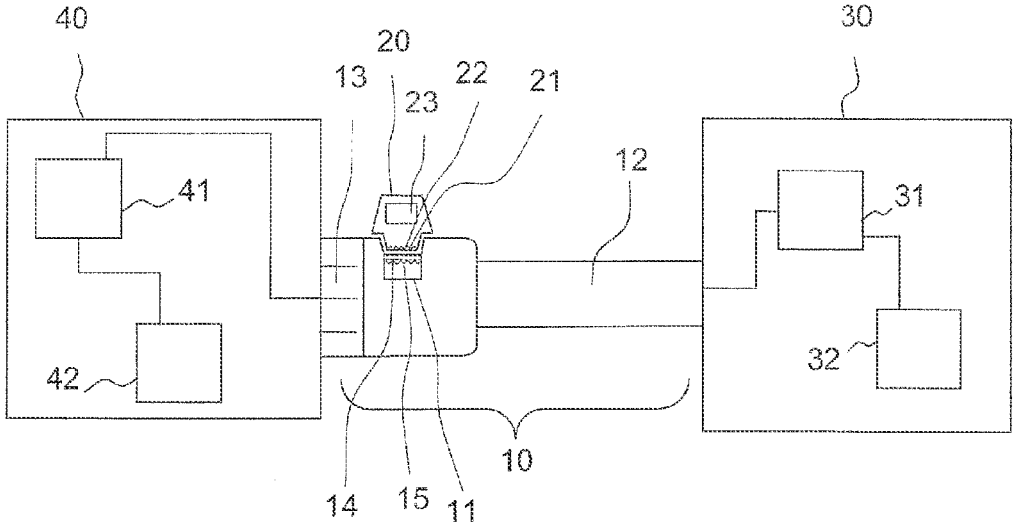
FIG. 1 shows an exemplary embodiment of a setting device according to the suggested principle.

The following list of reference symbols may be used in conjunction with the drawings:

10 plug-cable unit
11 plug connector
12 cable
13 plug module
14-17 contact
18 snap-in mechanism
19 housing
20 coding plug
21, 21 port
23 electronic component
24 housing
25 plug attachment
26 visual identification
27 marking
30 functional unit
31 motor
32 actuator
40 control device
41 evaluation unit
42 memory device

DETAILED DESCRIPTION OF ILLUSTRATIVE EMBODIMENTS

FIG. 1 shows an exemplary embodiment of a setting device according to the suggested principle. The setting device is suitable, in particular, for an electromechanically adjustable piece of furniture. A functional unit 30, to be controlled, of the piece of furniture is connected to a control device 40 of the piece of furniture via a plug-cable unit 10. The functional unit 30 to be controlled comprises a motor 31 and an actuator 32 driven by the motor 31. The plug-cable unit 10 comprises a cable 12, a plug module 13 and a plug connector 11. The plug connector 11 is mounted in a depression of the housing of the plug-cable unit 10 and designed to receive a coding plug 20. The plug connector 11, the end part of the cable 12 and the plug module 13 are arranged in the housing of the plug-cable unit 10 so as to be mechanically connected to one another and thus form a unit. The motor 31 is connected to the other side of the cable 12. The actuator, along with the motor, is designed for adjusting a position of a backrest of a chair, for instance. The plug connector 11 comprises at least two contacts 14, 15. The at least two contacts 14 and 15 of the plug connector 11 are in electrically conductive connection to the plug module 13. Moreover, ports of the plug module 13 are in electrically conductive connection to the cable 12.

The coding plug 20 has at least two ports 21 and 22 as well as an electronic component 23. The electronic component 23 comprises at least one parameter of the functional unit 30, to be controlled, of the piece of furniture. To give an example, the electronic component 23 comprises a resistor whose value represents an identification for the respective motor 31 of the functional unit 30.

The control device 40 comprises an evaluation unit 41 and a memory device 42 coupled thereto. The evaluation unit 41 is connected to the plug module 13 of the plug-cable unit 10. The memory device 42 serves for holding the at least one parameter provided by the coding plug 20.

The functional unit 30 to be controlled is connected to the control device 40 of the piece of furniture via the plug-cable unit 10. The coding plug 20 is plugged into the plug connector 11 of the plug-cable unit 10 or latched in place therein. Here, the contacts 14 and 15 of the plug connector 11 and the ports 21 and 22 of the coding plug 20 have complementary shapes so that an electrically conductive connection between coding plug 20 and plug-cable unit 10 is established. Having inserted the coding plug 20, the parameter comprised by the electronic component 23 is transferred to the evaluation unit 41 of the control device via the plug module 13. The control device 40 evaluates the parameter, deposits it in the memory device 42 and retrieves operational data from the memory device 42 associated to this parameter. The subsequent process of controlling the functional unit 30 is carried out depending on this operational data, i.e., as a function of the parameter provided by the component 23.

By means of the parameter, in this case the value of the resistor of the electronic component 23, the control device 40 is able to identify the motor 31 which is used and to correspondingly adapt the way of triggering the functional unit 30 to be controlled. Thus, the coding plug 20 in combination with the plug-cable unit 10 allows a coding of the functional unit 30 to be controlled, in particular of the motor 31 and/or actuator 32 used in the functional unit 30. The realization of the coding plug 20 is cost-efficient here. As the coding plug 20 can be inserted into the plug-cable unit 10 accessible from outside even after assembly of the piece of furniture, it is possible to always install the same cable 12 even for different functional units. Further, configuring the functional unit 30 on the basis of the parameter is made possible.

Figure 2A:
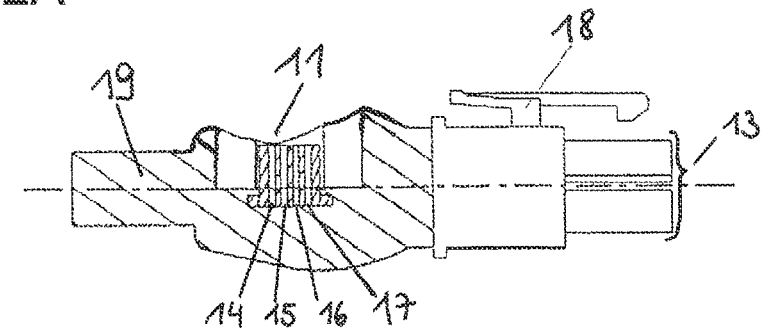
FIGS. 2A to 2D each show a view of an exemplary embodiment of a plug-cable unit according to the suggested principle.

FIG. 2A shows an exemplary embodiment of a plug-cable unit according to the suggested principle in a side view including a partial section through the housing. The ports of the plug module 13 as well as contacts 14, 15, 16 and 17 of the plug connector 11 can be seen. Here, the plug connector 11 is realized as a four-pole plug, for example. The contacts 14 to 17 are each realized as a metallic pin. The housing 19 is molded from plastic, for instance, and constitutes an insulating body. Further, a snap-in mechanism 18 is illustrated, which as a latching element serves for mechanically stabilizing and securing the connection between the plug module 13 and the control device 40 from FIG. 1.

Figure 2B:
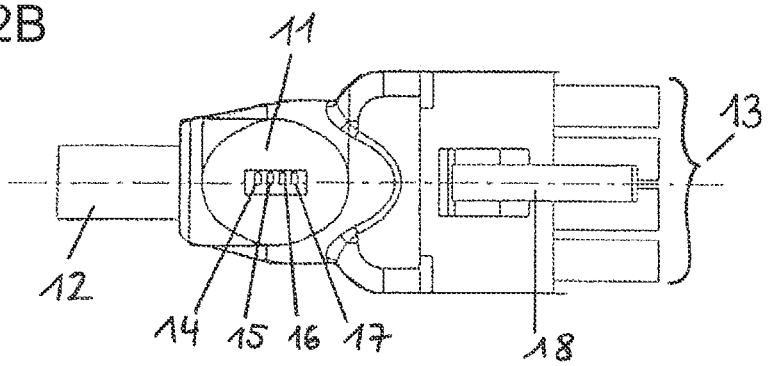

FIG. 2B shows a top view of the plug-cable unit according to the suggested principle, belonging to the embodiment shown in FIG. 2A. Here, the cable 12 can additionally be seen, which is coupled to the motor 31 of the functional unit 30, to be controlled, from FIG. 1. It can be taken from the illustration that the plug connector 11 is mounted in a cylinder-like depression of the housing of the plug-cable unit. Moreover, one can see that the plug module 13 is realized here as an eight-pole plug with metallic contacts, for example. For the plug module 13, a standardized plug according to DIN is used, for instance. As an alternative, it is also possible to use another plug which is not standardized.

Figure 2C:
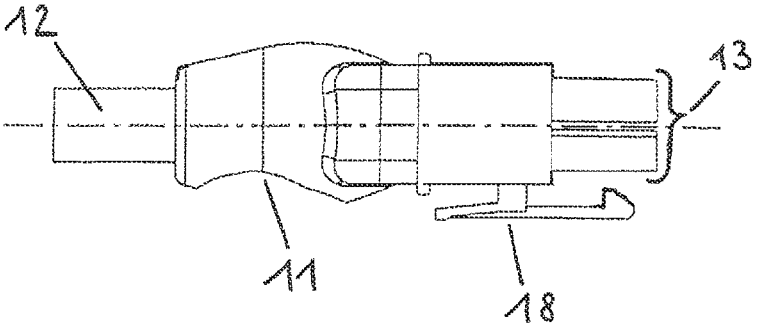

FIG. 2C shows a view of the other side of the plug-cable unit belonging to FIGS. 2A and 2B.

Figure 2D:
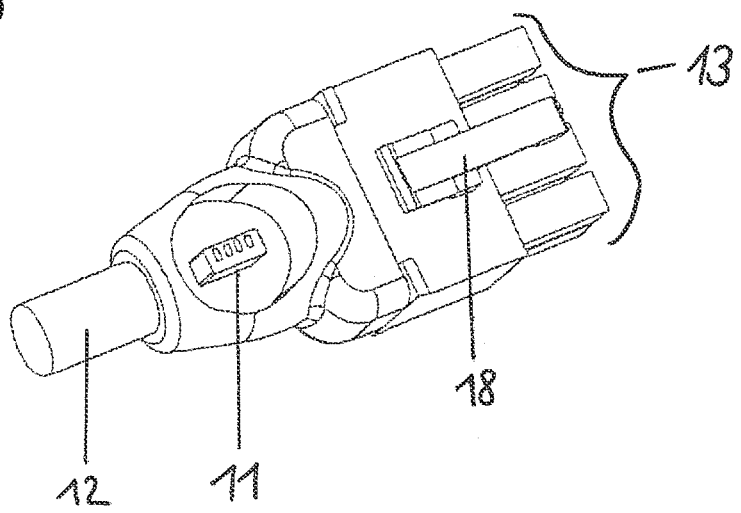

FIG. 2D shows a three-dimensional illustration of the embodiment of the plug-cable unit illustrated in FIGS. 2A to 2C. It can be seen clearly that the coding plug 20 from FIG. 1 can be plugged into the plug connector 11 advantageously even after assembly of the plug-cable unit 10, allowing a subsequent configuration of the functional unit 30.

Figure 2E:
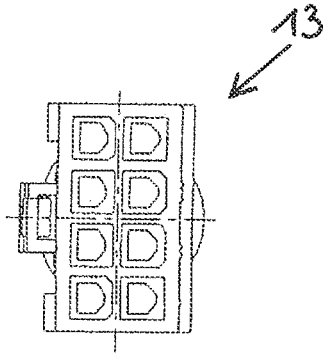
FIG. 2E shows an exemplary embodiment of a plug module.

FIG. 2E shows an exemplary embodiment of a plug module 13. This is a detail view of the embodiment of the plug module 13 shown in FIGS. 2A to 2D. As already mentioned, the plug module 13 is realized in an eight-pole design.

Figure 3A:
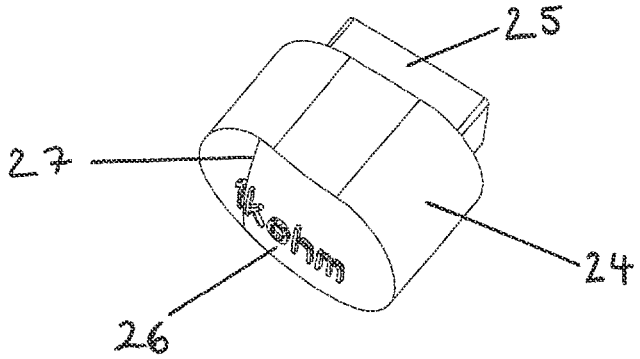
FIGS. 3A and 3B each show a view of an exemplary embodiment of a coding plug according to the suggested principle.

FIG. 3A shows a three-dimensional illustration of an exemplary embodiment of a coding plug according to the suggested principle. One can see a housing 24 of the coding plug including a plug attachment 25 mechanically connected thereto, comprising the ports 21 and 22 from FIG. 1 which are not visible in this illustration. A visual identification 26 is provided on the upper side of the housing 24. In this example, the visual identification 26 is realized as a labeling showing the value of the resistor of the electronic component comprised by the coding plug. Further, a marking 27 is provided which ensures that the coding plug is correctly inserted in the plug-cable unit.

Figure 3B:
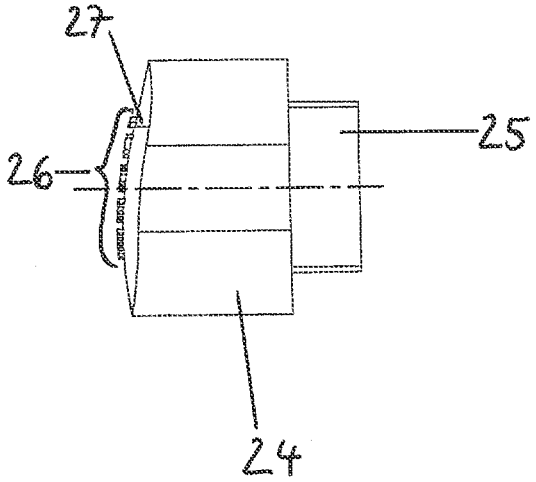

FIG. 3B shows a side view of the coding plug belonging to FIG. 3A.

The invention claimed is:

1. A plug-cable unit comprising:

a cable configured to be connected to a functional unit to be controlled, wherein the functional unit to be controlled is part of an electromechanically adjustable piece of furniture;

a plug module configured to be connected to a control device of the piece of furniture; and a plug connector configured to receive a coding plug such that the coding plug is removable from the plug connector, wherein the plug connector has an electrically conductive connection to the plug module and the cable has an electrically conductive connection to the plug module, wherein the cable, the plug module and the plug connector form the plug-cable unit, and wherein the plug module and the cable are located on opposite ends of the plug-cable unit and the plug connector is located in between the opposite ends.

2. The plug-cable unit according to claim 1, wherein the plug connector comprises at least two contacts that are configured to transmit at least one parameter of the functional unit to be controlled.

3. The plug-cable unit according to claim 1, further comprising a housing, wherein the plug module, the plug connector and the cable are mechanically connected to one another in the housing.

4. The plug-cable unit according to claim 1, further comprising a housing, wherein the plug module and the cable are mechanically connected to each other in the housing and wherein the plug connector is mounted in a receptacle outside the housing.

5. A coding plug comprising:

at least two ports configured to connect to related contacts of the plug connector of the plug-cable unit according to claim 1;

at least one electronic component comprising at least one parameter of a functional unit to be controlled, wherein the functional unit is part of an electromechanically adjustable piece of furniture, wherein the at least two ports are each mechanically and electrically connected to the at least one electronic component; and a housing, wherein the at least two ports are arranged in the housing.

6. The coding plug according to claim 5, wherein the at least one electronic component comprises a passive component.

7. The coding plug according to claim 5, wherein the at least one electronic component comprises a digital memory chip.

8. The coding plug according to claim 5, wherein the at least one electronic component comprises a passive component coupled to a digital memory chip.

9. The coding plug according to claim 5, further comprising a visual identification attached to the housing and designed so as to be suitable to the at least one parameter.

10. A setting device for an electromechanically adjustable piece of furniture, the setting device comprising:

a control device for the piece of furniture that is electromechanically adjustable;

a functional unit of the piece of furniture;

a plug module connected to the control device of the piece of furniture;

a cable connected to the functional unit, wherein the cable has an electrically conductive connection to the plug module;

a plug connector that has an electrically conductive connection to the plug module, wherein the plug module, the cable and the plug connector form a plug-cable unit, wherein the plug module and the cable are located on opposite ends of the plug-cable unit and the plug connector is located in between the opposite ends, and wherein the functional unit is connected to the control device via the plug-cable unit; and a coding plug comprising a plurality of ports configured to connect to related contacts of the plug connector and an electronic component comprising at least one parameter of the functional unit, wherein the ports are each mechanically and electrically connected to the electronic component, the ports and the electronic component being arranged in a common housing, wherein the at least one parameter of the functional unit comprised by the electronic component of the coding plug is made available to the control device via the plug-cable unit, and wherein the plug connector is configured to receive the coding plug such that the coding plug is removable from the plug connector.

11. The setting device according to claim 10, wherein the functional unit comprises a motor connected to the cable of the plug-cable unit and an actuator driven by the motor, the actuator configured to adjust the functional unit.

12. The setting device according to claim 10, wherein the control device comprises an evaluation unit connected to the plug module of the plug-cable unit.

13. The setting device according to claim 12, wherein the control device further comprises a memory device connected to the evaluation unit, the memory device configured to store the at least one parameter.

14. A method for configuring a functional unit of an electromechanically adjustable piece of furniture, the method comprising:

plugging a coding plug into a plug-cable unit such that the coding plug is removable from the plug-cable unit, the plug-cable unit comprising a cable configured to be connected to the functional unit to be configured, a plug module configured to be connected to a control device of the piece of furniture, and a plug connector configured to receive the coding plug, wherein the plug connector has an electrically conductive connection to the plug module and the cable has an electrically conductive connection to the plug module, wherein the cable, the plug module and the plug connector form the plug-cable unit, and wherein the plug module and the cable are located on opposite ends of the plug-cable unit and the plug connector is located in between the opposite ends;

connecting a functional unit of the piece of furniture to the control device of the piece of furniture via the plug-cable unit;

reading out at least one parameter of the functional unit from the coding plug; and adjusting the control device of the piece of furniture to control the functional unit as a function of the at least one parameter.

15. The method according to claim 14, wherein the functional unit comprises a motor and an actuator driven by the motor, the actuator configured to adjust the piece of furniture.

16. The method according to claim 14, wherein the control device comprises an evaluation unit connected to the plug-cable unit.

17. The method according to claim 14, further comprising storing the at least one parameter in a memory device of the control device.

* * * * *